United States Patent [19]

Grivna et al.

[11] Patent Number: 5,016,306

[45] Date of Patent: May 21, 1991

[54] GRIPPER DEVICE

[76] Inventors: Gerald J. Grivna, 1001 County Rd. 837, Bailey, Colo. 80421; Robert N. Thompson, 9888 E. Vassar Dr., Apt. D-105, Denver, Colo. 80231

[21] Appl. No.: 419,266

[22] Filed: Oct. 10, 1989

[51] Int. Cl.[5] ..... A47C 21/02

[52] U.S. Cl. ..... 5/498; 24/72.5; 24/530; 24/136 R; 5/496

[58] Field of Search ..... 5/460, 494, 496, 498, 5/499; 24/72.5, 115 M, 136 R, 136 L, 461, 462, 536, 537

[56] References Cited

U.S. PATENT DOCUMENTS

| | | | |
|---|---|---|---|
| 2,149,971 | 3/1939 | Liebmann | 24/72.5 |
| 2,195,967 | 4/1940 | Liebmann | 24/72.5 |
| 2,225,875 | 12/1940 | Liebmann | 24/72.5 |
| 2,826,766 | 3/1958 | Stoner | 5/498 |
| 2,913,791 | 11/1959 | Martin | 24/136 R |
| 3,816,885 | 6/1974 | Saether | 24/462 |
| 3,952,377 | 4/1976 | Morell | 24/136 R |
| 4,333,649 | 6/1982 | Vaughn et al. | 24/115 M X |

*Primary Examiner*—Michael F. Trettel
*Attorney, Agent, or Firm*—Norvell E. Von Behren

[57] ABSTRACT

A gripper device for holding a flexible flat sheet around an elongated form such as a cord, rope, protruding edge or the like. The device is formed in the preferred embodiment with an inner hinged gripper which is positioned around the elongated form such as a protruding edge on a bed mattress. An outer clamp is formed in a C-shaped configuration and slides over the inner hinged gripper. To apply a force or pressure on the gripper, a tapered surface is formed on the outer side of the inner gripper and on the inner side of the outer C-shaped clamp.

21 Claims, 2 Drawing Sheets

GRIPPER DEVICE

CROSS REFERENCE TO RELATED APPLICATIONS

U.S. Design Pat. application Ser. No. 07/390915, filed Aug. 8, 1989 in Group Art Unit 291 by Gerald J. Grivna and Robert N. Thompson and entitled, "Design for a Lower Sheet Retainer for a Bed"

BACKGROUND OF THE INVENTION

This invention relates generally to a gripping device and more particularly to a novel gripping device designed to grip a flexible flat surface such as a bed sheet, blanket, canvas, tarpaulin or the like around an elongated form such as a cord, rope, protruding edge or the like.

It is known by most people that a bed sheet can be easily pulled out of place on the bed by a restless sleeper moving around during the sleeping process. While tucking the lower ends of the bed sheet under the mattress helps somewhat, it would be more desirable to provide a more positive way to hold the sheet in its proper place on the mattress.

Certain types of bed sheets also pose more problems for the typical sleeper that tosses and turns during the sleeping process. Sheets made of silk or satin material are especially prone to easy dislocation, since they usually have extremely smooth, slick surfaces that do not have a frictional restraining surface such as is common with cotton sheets. As a result, the prior art method of tucking the sheet edges under the mattress is usually only initially cosmetic. The first movement of the sleeper in the bed can and usually does act to pull this type of sheet out from under the mattress.

It is also known that small infants in cribs often kick off their sheets as well as blankets and their turning over will do the same thing. It would be desirable to also have some gripping device that could be used on infant beds with the device being large enough to hold both a sheet and a blanket onto the crib mattress. In addition the device would have to be formed of a size sufficiently large to prevent the infant from putting it into his mouth where it could be easily swallowed.

In the outdoor area, it is often necessary to tie down weather covers over a truckload or on a boat and the usual way is to provide a large tarpaulin with grommets sewn around the edges. A rope or cord is then threaded into the grommets and is tied down to an appropriate anchor or tie-down post. While such tie-downs are usually satisfactory for standard sizes, they require a lot of time to initially thread the rope or cord through the grommets and then to reverse the process whenever the cover is to be removed. It would be desirable to have a means of quickly and easily covering and uncovering a load as well as to be able to handle oversized bulky loads without the use of special shaped tarps with their installed grommets.

Another area of use for a new type holding device would be for outdoorsmen such as hunters, hikers or the like, who might need to set up a quick weather shelter such as a tent or lean-to during sudden weather changes or during an emergency. It would be very desirable to have such a device which could be used with lightweight covers that would not need to be prepared with grommets and could easily be packed in a knapsack or the like.

SUMMARY OF THE INVENTION

In order to overcome the problems before mentioned with prior art holding and fastening devices, there is provided a new and novel gripping device designed to grip a flexible flat surface such as a bed sheet, blanket, tarpaulin or the like. The novel device is designed to grip the flexible flat surface when it has been positioned around an elongated form such as a cord, rope, protruding edge or the like.

The applicants' novel gripper device comprises, in the preferred embodiment, an inner elongated hinged gripper formed from a flexible plastic such as polypropylene. The hinged gripper contains an inner semicircular gripping area that is formed in the general shape of the cord or rope over which it is positioned. A gripping edge is also provided on the gripper to enhance the holding ability of the hinged gripper.

In the preferred embodiment, the hinged gripper also is formed with a taper on its outer surface ranging between 2° and 6° with the preferable taper being 4°. An outer clamp, formed from a rigid plastic, is used to position over the inner hinged gripper. The outer clamp has an inner surface with a taper that corresponds to the taper on the gripper. The use of the mating tapers permits the outer clamp to slide over the inner hinged gripper after the gripper has been positioned on the flexible flat surface which is positioned around the elongated form such as a cord, rope, protruding edge or the like.

While the tapers on the outer clamp and the inner hinged gripper are used to provide the means to exert a force or pressure on the gripper in the preferred embodiment, other means are possible within the spirit and scope of the invention. In addition to the embodiment described there are other features to the applicants' invention which will be shown and described hereinafter which make the novel gripping device usable in many other applications than those available to known prior art holding and gripping inventions.

Accordingly it is an object and advantage of the subject invention to provide a new and novel gripping device that can be used with any material such as silk, stain, plastic, tarpaulin material or the like without the material effecting the holding ability of the gripper device.

Another object and advantage of the subject invention is to provide a new design for a gripper which can be used on most types of beds, air mattresses, soft-side beds or the like that are used in homes, institutions, recreational campers, and boats, among others.

Still another object and advantage of the subject invention is to provide a gripping device that can be used by outdoorsmen to quickly set up a temporary or permanent shelter from adverse weather conditions.

A further object and advantage of the subject invention is to provide a gripping device design that can be made to hold bed sheets onto mattresses as well as crib sheets and crib blankets onto baby crib mattresses with the size of the latter design being such that prevents the infant from swallowing the device.

These and other objects and advantages of the invention will become apparent from a study of the drawings showing the preferred embodiment and its modifications as well as a reading of the Description of the Preferred Embodiment and the claims to be detailed hereinafter.

BRIEF DESCRIPTION OF THE DRAWINGS

FIG. 16 is a perspective view of a modified form of the clamp used with the applicants' novel gripper device and showing the clamp with a protuberance formed thereon to receive a second elongated form such as a cord, rope, strap or the like.

DESCRIPTION OF THE PREFERRED EMBODIMENT

Figure 1:
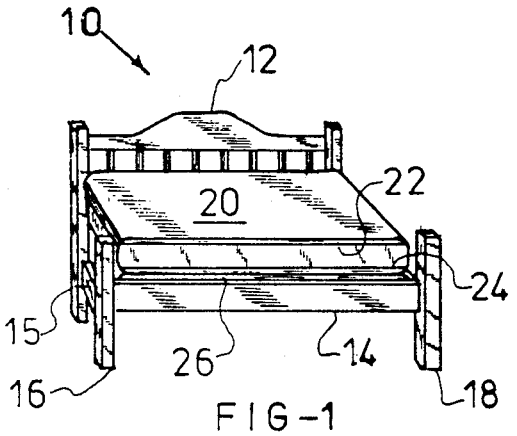
FIG-1 PRIOR ART
FIG. 1 is a perspective view of a typical prior art bed to which the applicants' device may be applied.

Referring now to the drawings in general and in particular to FIG. 1 of the drawings there is shown a perspective view of a typical prior art type bed 10 to which the applicants' novel device may be applied in the preferred embodiment. The bed 10 has a headboard 12 and a footboard 14 connected by side rails 15. The footboard 14 is constructed with a left post 16 and a right post 18.

Figure 2:
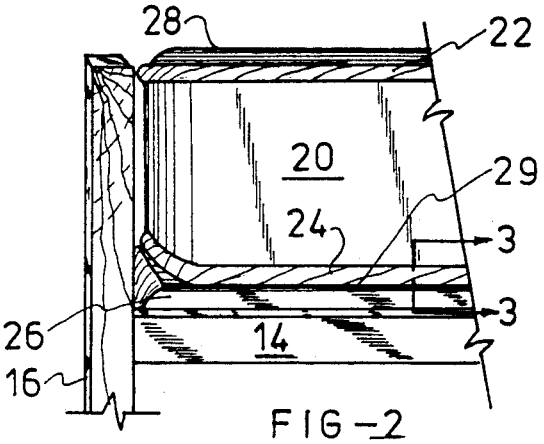
FIG-2 PRIOR ART
FIG. 2 is an enlarged view of one corner of the footboard for the bed shown in FIG. 1 and showing a typical mattress positioned on top of a box spring.

A mattress 20, having an upper protruding edge or bead 22 and a lower protruding edge or bead 24, sits on top of a box spring 26. Referring now to FIG. 2 of the drawings there is shown an enlarged view of one corner of the footboard for the bed 10 and in particular the left corner by the left post 16. In FIG. 2 there can be seen in more detail, the upper and lower protruding edges 22 and 24 which are positioned below the top 28 of the mattress and above the bottom 29 of the mattress.

Figure 3:
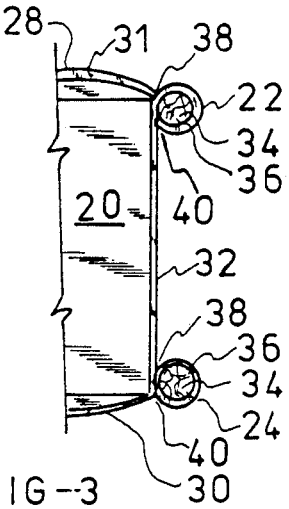
FIG-3 PRIOR ART
FIG. 3 is a cross-sectional view, taken along lines 3—3 of FIG. 2 showing in detail the construction of the lower protruding edge on the mattress of FIG. 2.

By referring now to FIG. 3, there can be seen a cross-sectional view, taken along lines 3—3 of FIG. 2 which shows in still more detail the position and construction of the upper and lower protruding edges 22 and 24. In the preferred embodiment, these edges may be used with the applicants' novel gripper device to hold a bed sheet onto the top 28 of the mattress 20. While the preferred edge to use would be the lower edge 24, it may be desired to use the upper edge 22 instead.

Most mattresses 20 are formed with fabric side panels 32 which are sewn to a fabric bottom panel 30 and to a fabric top panel 31. An internally positioned cord 34 is used with an outer fabric cover 36 to join the side panels 30 to the top panel 31 and the bottom panel by sewing in a known manner. While the construction may vary from mattress to mattress, an elongated protruding edge is formed by the construction with an upper area or edge 38 and a lower area or edge 40 which are used to attach the applicants' novel gripping device to the mattress 20.

Figure 4:
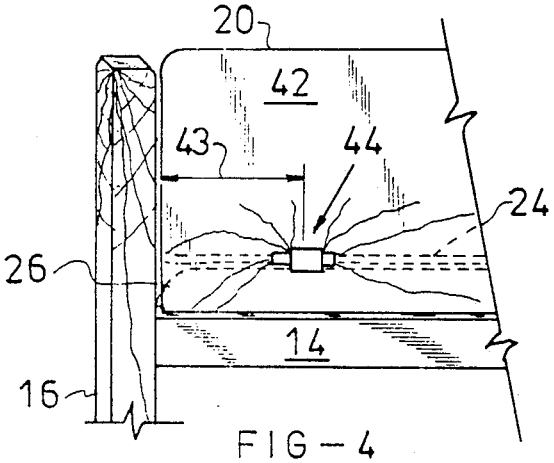
FIG. 4 is an enlarged end view, similar to the view of FIG. 2, showing a sheet or blanket positioned over the mattress and being held in place by the applicants' novel gripper device.

Referring now to FIG. 4 of the drawings, there is shown an enlarged end view, similar to the view of FIG. 2 showing a bed sheet 42 or blanket positioned over the mattress 20 and over an upper portion of the box spring 26. The applicants' novel gripper device, shown generally by the numeral 44 is positioned as shown to grip onto the elongated areas 38 and 40 of the lower edge 24 of the mattress over the sheet 42 to tightly hold the sheet 42 in place. The recommended position for the gripper device placement for a twin size mattress would be approximately 8 to 10 inches from the bed posts 16 and 18 along the end of the bed as shown by the numeral 43.

Where the mattress is a queen or king size, then it may be desirable to have a third gripper device positioned between the end grippers. It may also be desirable to position the gripper devices, as an alternate, around the sides of the bed near the end posts 16 and 18 if it is inconvenient to reach the protruding lower edge 24 due to the construction of the footboard 14 for the particular bed. It may also be desirable to grip the top sheet and the bottom sheet on a bed as well as a blanket and the applicants' gripper may be modified in size to handle those as well.

Figure 5:
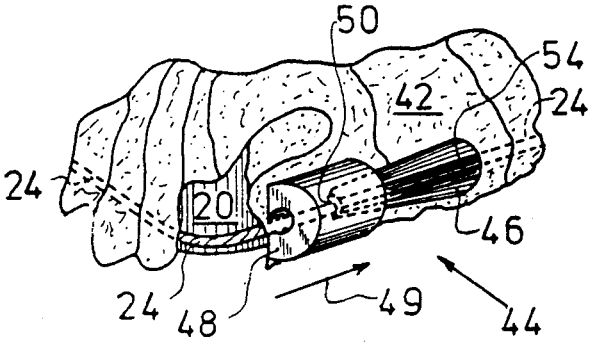
FIG 5 is an enlarged perspective view showing how the applicant's novel gripper device is attached to the lower protruding edge of the mattress to hold the sheet or blanket in place.

Referring now to FIG. 5 of the drawings, there is shown an enlarged perspective view showing how the gripper device 44 is attached to the lower protruding edge 24 of the mattress 20. The novel device is formed, in the preferred embodiment, in two pieces comprising an inner hinged gripper 46 which is used to position the flat flexible sheet around the protruding edge 24. Gripping edges, not shown in FIG. 5, of the hinged gripper 46 then are positioned into the gripping areas or edges 38 and 40 shown in FIG. 3.

A rigid plastic outer clamp 48 is then positioned over the inner plastic hinged gripper 46 in the direction shown by the arrow 49 to force the inner surface 50 tightly around the flexible flat bed sheet 42 and around the elongated protruding edge 24 of the mattress. In the preferred embodiment, the gripper device is formed with tapers on the mating surfaces, as will be later described, to provide the force or pressure means to tightly hold the device together which then holds the bed sheet clamped in position on the mattress.

Figure 6:
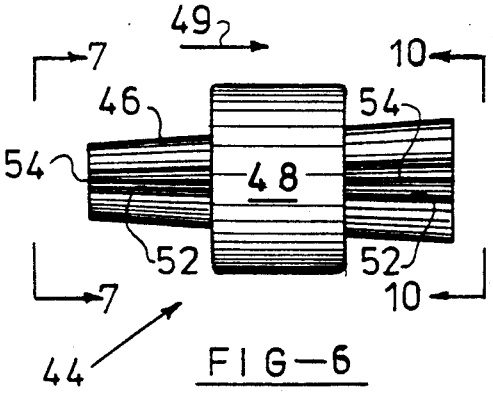
FIG. 6 is a front elevational view of the gripper device shown with the two parts of the preferred embodiment positioned together.

By referring now to FIG. 6 of the drawings, there is shown a front elevational view of the gripper device 44 shown with the outer clamp 48 positioned over the inner hinged gripper 46. The inner gripper 46 is hinged along a hinge line 54 formed by the elongated semicircular area 52 formed on one side of the outer surface of the hinged gripper. More details on the construction of the hinged gripper will be given hereinafter when referring to FIGS. 9 and 10 of the drawings.

Figure 7:
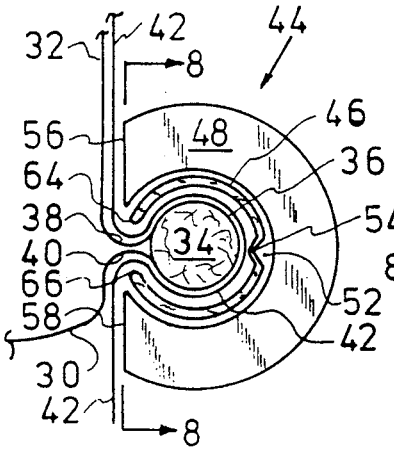
FIG. 7 is an end elevational view, taken along lines 7—7 of FIG. 6, showing the gripper device as it would be used to attach to the lower protruding edge of a mattress.

Referring now to FIG. 7 of the drawings there is shown an enlarged end elevational view, taken along lines 7—7 of FIG. 6, showing the applicants' novel gripper device 44 attached to the bed mattress and tightly holding the bed sheet in place. In FIG. 7, the side fabric panel 32 of the bed is shown continuously joined to the bottom fabric cover 30 for purposes of clarity when in fact it is usually constructed in several pieces and joined to the bottom cover by the fabric cord 34. FIG. 7 is used primarily, not to show a particular mattress construction, but to show how the areas or edges 38 and 40 of a mattress are used with the applicants' novel gripper device 44.

In FIG. 7 there can be seen how the elongated gripper edges 64 and 66 are positioned in the areas 38 and 40 and force the sheet 42 around the cord 34 with its outer material 36 while the outer clamp 48 is tightly positioned against the side panel 32 of the bed with the surfaces 56 and 58 in juxtaposition to the bed sheet 42. There can also be seen in FIG. 7 the construction of the hinge along the hinge line 54 for the hinged gripper 46.

Figure 8:
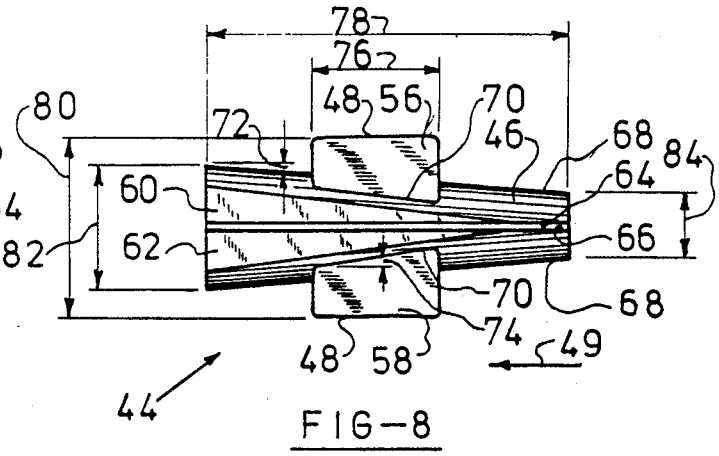
FIG. 8 is a rear elevational view, taken along lines 8—8 of FIG. 7.

Referring now also to FIG. 8 of the drawings, there is shown a rear elevational view, taken along lines 8—8 of FIG. 7, where it can be seen how the inner hinged gripper 46 is constructed with opposite flat surfaces 60 and 62 which are constructed along the same plane as the flat surfaces 56 and 58 of the outer clamp. These flat surfaces 56, 58, 60 and 62, permit the gripping device 44 to be closely positioned against the bed sheet 42 and to be tightly positioned around the cord 34 into the areas 38 and 40. In FIG. 8 the mating gripper edges 64 and 66 have been shown spaced apart somewhat as they would be whenever a bed sheet or blanket was being gripped between them. For purposes of clarity, in FIG. 8 the sheet or blanket has been omitted in order to more clearly understand the construction of the novel gripper device.

FIG. 8 also shows in more detail the elongated mating gripper edges 64 and 66 which are opposite to the hinge line 54 on the internally positioned hinged gripper 46. As before mentioned, the novel gripper device 46 has formed thereon means to exert a force or a pressure on the inner hinged gripper 46 to tightly hold the entire device on the cord 34. In the preferred embodiment shown, a pair of tapers are formed in the two parts of the device to provide this force or pressure. A tapered surface 68 is formed around the outer portion of the hinged gripper 46 and a similar tapered surface 70 is formed around the inside of the rigid outer clamp 48.

The angle of the gripper taper, shown by the numeral 72 would range approximately between 2° and 6° and preferably would be approximately 4° in the preferred embodiment. The angle of the clamp taper, shown by the numeral 74 would also range approximately the same, between 2° and 6° with the preferable approximately 4°. However, other angles and constructions may also be used within the spirit and scope of the invention. By the use of tapers, constructed as shown, a force or pressure is able to be obtained whenever the outer clamp 48 is forced over the inner gripper 46 in the direction shown by the arrow 49. The angle range of 2° to 6° on the tapers also permits the parts to be easily forced together and removed from each other while still tightly holding the sheet 42 onto the cord 34 when in place.

While the particular taper construction has been utilized in the preferred embodiment, it should be seen that other placements of the tapers can be made and other forms of pressure or force means can be designed within the spirit and scope of the invention. The actual size of the gripper device, when constructed for use on a bed mattress, would be approximately 2 inches long as shown by the numeral 78 with the clamp being constructed approximately 1 inch long as shown by the numeral 76. A suggested outer diameter of the clamp, shown by the numeral 80 would be approximately 1 inch and a suggested diameter, of the large end of the gripper shown by the numeral 82, would be approximately ¾ inch. The suggested diameter of the small end of the gripper, shown by the numeral 84, would be approximately ⅜ inch.

From experimentation, it has been found that the preferable material to be used for the inner gripper 46 would be polypropylene plastic which permits the hinge to flex or move back and forth many times without cracking. It is believed that a nylon construction of the hinged gripper would not work as well, especially at the hinge which would fatigue quicker and crack sooner. In addition, a material commonly known as ABS plastic may be too rigid for use in the hinged inner gripper. In addition, it is believed that a material such as Teflon may be too slippery for the inner gripper construction and may not provide the necessary gripping surface unless used with a modified gripper edge to be discussed hereinafter.

The material used for the outer clamp 48 may also be polypropylene in the preferred embodiment but may be of other materials, such as a rigid plastic, that will permit the outer clamp 48 to remain rigid when forced onto the inner gripper 46. The use of polypropylene in the size shown, however, provides a rigid outer clamp that operates satisfactorily.

Figure 9:
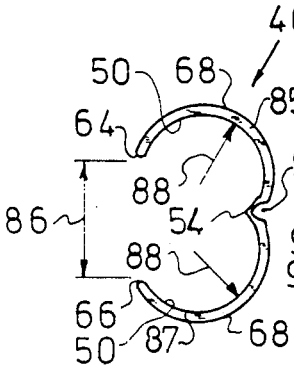
FIG. 9 is an end elevational view, taken along lines 7—7 of FIG. 6, showing one end of the hinged gripper of the applicants' invention and having the outer clamp removed from the device for purposes of clarity.

Referring now to the drawing FIGS. 9 and 10, there will be described in more detail the construction of the inner hinged gripper 46. FIG. 9 is an end elevational view, taken along lines 7—7 of FIG. 6, showing the small end of the hinged gripper 46 with the gripper being shown partly opened as it would be when positioning it around a sheet and the edge 24 on a mattress. In FIG. 9, the outer clamp 48 has been removed for purposes of clarity. The hinged gripper is formed, in the preferred embodiment, in a one-piece configuration with a semi-circular upper section 85 and a semicircular lower section 87 joined together by a hinged section with a hinge line 54. The preferred thickness of the hinge, along the hinge line 54, would be approximately 8 to 10 thousandths of an inch when constructed out of polypropylene.

The upper semicircular section 85 and the lower semi-circular section 87 would be constructed with a radius of approximately 5/32 inch as shown by the numeral 88. This would then permit the gripper to be positioned around the mattress cord 34 which is approximately ⅜ inch in diameter. The inner gripper must be able to open up, as shown by the numeral 86, at least ⅜ to ½ inch when used on a bed and may have to open a larger amount depending upon the size of the elongated form it grips. Accordingly the radius 88 of the inner surface of the gripper may be varied in size from that given herein and the thickness of the hinge line 54 and the material of the gripper may also be varied within the spirit and scope of the invention.

Figure 10:
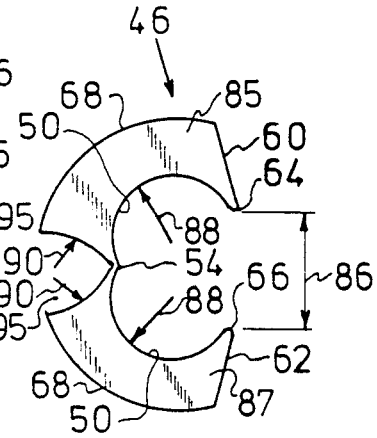
FIG. 10 is an end elevational view, taken along lines 10—10 of FIG. 6, showing the other end of the hinged gripper of the applicants' invention and having the outer clamp removed from the device for purposes of clarity.

Referring now to FIG. 10, there is shown an end elevational view, taken along lines 10—10 of FIG. 6 and showing the large end of the hinged gripper with the gripper also being shown partly opened. For purposes of clarity the outer clamp 48 has been removed and the device in FIG. 10, as well as FIG. 9, has been enlarged. The hinge is formed with a radius, shown by the numeral 90, of approximately ¼ inch on the upper section 85 and the lower section 87 as shown and terminating in the hinge line 54 which is approximately 8 to 10 thousandths of an inch thick. The radius, shown by the numeral 90, is used and needed when the outer C-shaped clamp 48 is modified as described later and provides a female semicircular space or opening which can be used to mate with a male protuberance formed along the inside surface of the outer C-shaped clamp 48.

Figure 11:
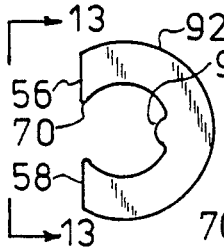
FIG. 11 is an end elevational view, taken along lines 7—7 of FIG. 6, showing one end of a modified clamp for the applicants' device and having the inner hinged gripper removed from the device for purposes of clarity.
Figure 13:
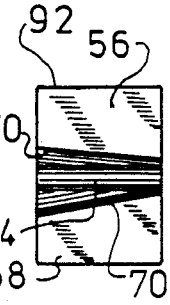
FIG. 13 is a rear elevational view, taken along lines 13—13 of FIG. 11.
Figure 12:
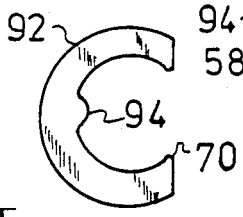
FIG. 12 is an end elevational view, taken along lines 10—10 of FIG. 6, showing the other end of the modified clamp of FIG. 11 and having the inner hinged gripper removed from the device for purposes of clarity.

This modified clamp, shown as numeral 92 in FIGS. 11–13 may be used to help align the clamp 92 over the inner gripper 46 with the female semicircular space 95, formed by the two radii 90 mating with the semicircular male protuberance 94.

Figure 14:
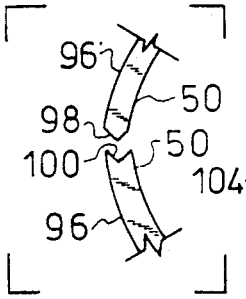
FIG. 14 is a partial end elevational view, similar to the view of FIG. 9, showing a modified form of the gripping edges on the inner hinged gripper used to enhance the holding ability of the gripper.

Referring now to FIG. 14, there is shown a partial end elevational view, similar to the view of FIG. 9 and showing a modified form 96 of the elongated gripping edges 64 and 66 of the hinged gripper 46. Some bed sheets formed from silk or satin material tend to be very smooth on the surface and, in fact, can be referred to as having a "slick" surface. The gripper edges can be constructed with mating gripping edges as shown in FIG. 14 with a male edge 98 formed on one section and a female edge 100 formed on the other section of the gripper. When formed thusly, the flexible flat silk or satin sheet will be forced in a V-shape between the opposite edges 98 and 100, thereby reducing the chances of the sheet being pulled out of the gripper by an overly active sleeping person. The inner surface 50 of the gripper may also be formed with a knurled or rough surface in order to further enhance the gripping abilities for silk or satin sheets.

Figure 15:
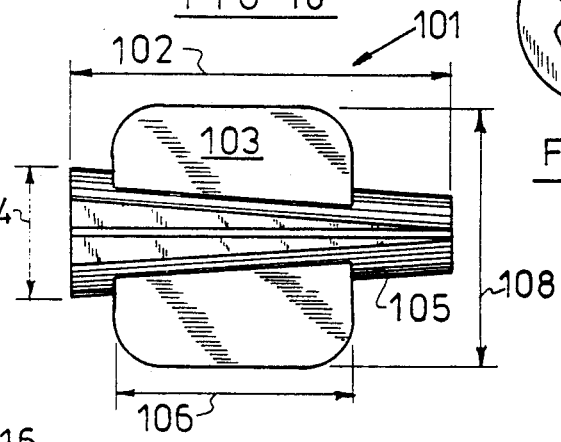
FIG. 15 is a rear elevational view, similar to the view of FIG. 8, showing a modified form of the applicants' novel gripper device which can be used on infant cribs to hold the sheet and blanket onto the lower protruding edge of the crib mattress.

Referring now to FIG. 15 of the drawings there is shown a modified form of the complete gripper device generally by the numeral 101. The applicants' basic novel gripper device may also be used with a baby mattress to hold the crib sheet and/or the crib blanket in place. Since the standard construction of baby crib mattress is similar to that of regular mattresses with upper and lower edges 22 and 24, the modified form of the invention 101 may be used. For safety reasons however, the device has been formed in different proportions to prevent accidental ingestion of either part by the baby. The outer C-shaped clamp 103 has been formed larger than normal and the inner hinged gripper 105 has been formed larger and longer than normal to accommodate a much thicker crib blanket than a bed sheet. The larger and longer size of the modified gripper device 101 is also necessary for the safety reasons mentioned should the device become separated and should the baby try to put one or both of the separate parts in his mouth.

It is believed that whenever the inner gripper 105 is formed approximately 2-½ inches long, as shown by the numeral 102 with an enlarged outer diameter of the large end, shown by the numeral 104, being approximately ¾ inch, then the inner gripper 105 will not be able to be swallowed by a baby. The length 102 of 2-½ inches should prevent the inner gripper from going around the inside of the baby's mouth and down into his throat. In addition, it is believed that the outer C-shaped clamp 103 should be constructed with a length, shown by the numeral 106 of approximately 1-½ inches and another diameter, shown by the numeral 108, of 1-¾ inches to prevent the baby from putting this piece into his mouth. As a result, the modified form 101 of the applicants' device should be safe for use with a baby crib according to accepted medical safety standards.

Figure 16:
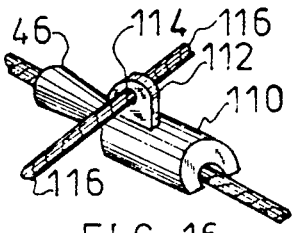
Figure 17:
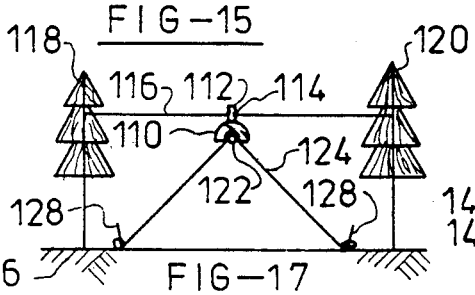
FIG. 17 is an elevational view showing the use of the modified gripper device of FIG. 16 to set up a tent shelter between several trees.

Turning now to FIG. 16, there is shown another modified form of the outer C-shaped clamp shown generally by the numeral 110. In the perspective view of FIG. 16 there is shown a modified clamp 110 which is formed with an upward extending longitudinal protuberance 112 having a transverse hole 114 formed therein. The hole 114 is used to position a second elongated form 116 such as a cord, rope, strap or the like. A hinged inner gripper 46 would be used with the modified clamp 110 and FIG. 17 shows how the modification could be used in an outdoor setting to construct a tent or lean to between opposite trees 118 and 120. The second elongated form 116 would be tied between the trees 118 and 120 after being positioned through the opening 114. The rope 122 may then be positioned beneath the flexible flat sheet 124 and the inner gripper would be positioned over the outer side of the sheet or tarpaulin 124 and would be locked in place by the modified outer clamp 110. If the tarpaulin 124 had an elongated edge, such as a cord, sewn into the tarpaulin then the rope 122 could be omitted.

When formed in the configuration shown in FIG. 10, several elongated forms 116 would need to be positioned between other trees behind the trees 118 and 120 so that the entire tarpaulin 124 can be held in place by the applicants' modified gripper device 110. The tarpaulin 124 could then be spread apart as shown in FIG. 17 and could be staked to the ground 126 by the stakes 128.

Figure 18:
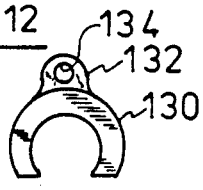
FIG. 18 is an end elevational view of another modified form of the outer clamp of the applicants' invention.
Figure 19:
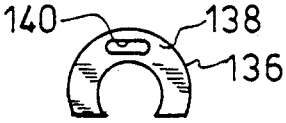
FIG. 19 is an end elevational view of still another modified form of the outer clamp of the applicants' invention.

The outer C-shaped clamp may also be modified, as shown in FIG. 18 by the numeral 130, having an upwardly extending transverse protuberance 132 formed thereon and with a longitudinal hole 134 to receive the second elongated form such as the rope 116 of FIG. 17. The outer C-shaped clamp may also be modified, as shown in FIG. 19 by the numeral 136, with an enlarged upper outer surface 138 having a longitudinal opening 140 designed to receive a second elongated form such as the rope 116 or a strap. The FIG. 19 version may also be modified to provide a transverse opening 140 in the upper outer surface also.

When the outer clamp is modified as shown in FIGS. 18 or 19, then the gripper device can be used with only one second elongated form 116 spanning between the two trees 118 and 120 when forming a tent or lean-to 124 as shown. The modified gripper device may also be used in other installations such as on a truck to cover inner cargo or on a boat to name a few installations.

Figure 20:
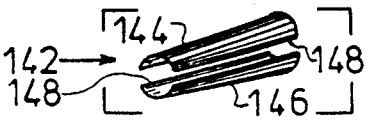
FIG. 20 is a perspective view of a modification of the inner gripper shown formed in a two-piece configuration.

The inner hinged gripper may also be modified as shown in FIG. 20 to form it in two pieces shown generally by the numeral 142 with an upper portion 144 and a lower portion 146, both of which have elongated edges 148 designed to be tightly held together by an outer clamp or force means. In addition, the two piece inner gripper 142 may also be formed with the improved gripping edges of the type shown in FIG. 14. While the use of a two-piece inner gripper 142 may not appear to be convenient, since the two loose pieces may easily be lost, in cases where the gripped piece of material is not to be removed routinely, this variation may be a less expensive alternative to the hinged version.

Other modifications are also possible in the design of the various parts of the gripper device. While tapers have been used on the inside of the clamp and on the outside of the hinged gripper in the preferred embodiment to obtain the means to apply a force or pressure to accomplish the gripping, other designs are possible within the spirit and scope of the invention.

From the foregoing it can be seen that there has been accomplished all of the objects and advantages of the subject invention and many others. While the preferred embodiment has been shown and described along with several modifications, the exact embodiments given are not to be considered as limiting. These embodiments have been given by way of illustration only and the scope of the applicants' patent is not to be determined by the preferred embodiments shown and described which are only illustrative.

Having described our invention, we claim:

1. A device used with similar separate devices for gripping a flexible flat surface in a plurality of spaced apart positions around an elongated form such as a cord, rope, protruding edge or the like to hold the flexible flat surface tightly in juxtaposition around the elongated form at the plurality of spaced apart positions, comprising:

(a) an inner short hinged gripper having a hinge area separating two remaining areas, the gripper being designed for positioning partly around the elongated form with the flexible flat surface positioned over the elongated form and held around the form by the gripper, the hinged gripper having an outer surface and having the hinged area formed thinner than the two remaining areas of the gripper so that the two remaining areas may pivot around the hinge area;

(b) an outer short clamp for positioning partly around the hinged gripper after the hinged gripper is positioned over the elongated form with the flexible flat surface between the hinged gripper and the form, the outer short clamp having an inner surface; and (c) means, associated with the hinged gripper and the clamp to exert a force on the hinged gripper to tightly hold the hinged gripper in place on the elongated form and on the flexible flat surface.

2. The device as defined in claim 1 wherein the hinged gripper has formed thereon mating gripper edges to improve the gripping abilities of the device.

3. The device as defined in claim 1 wherein the hinged gripper is formed from a flexible plastic and the outer clamp is also formed from a plastic material.

4. The device as defined in claim 3 wherein the hinged gripper is formed with a hinge having a thickness ranging from 8 to 10 thousands of an inch and the flexible plastic is a polypropylene which permits the hinge to move back and forth without cracking.

5. The device as defined in claim 1 wherein the means to exert a force comprises a taper being formed on the outer surface of the gripper and on the inner surface of the clamp.

6. The device as defined in claim 5 wherein the taper formed on the clamp and the gripper ranges approximately between 2° and 6°.

7. The device as defined in claim 6 wherein the taper is approximately 4°.

8. In a bed of the type having a mattress with an elongated cord sewn into the top and bottom of the mattress around the perimeter to form an upper and lower edge around the perimeter and with the bed having at least one sheet positioned over the mattress, the improvement comprising:

(a) the sheet being positioned over at least one of the mattress edges;

(b) at least one sheet gripper having an outside surface and being positioned over the sheet at a predetermined position along the mattress edge, a portion of the sheet gripper formed in an elongated hinged configuration with elongated gripping edges and positioned around a portion of the sheet and a portion of the mattress edge to grip the sheet against the mattress edge, the sheet gripper being formed of plastic with two elongated semicircular configurations being joined along a common edge in a hinge; and (c) pressure means, associated with the sheet gripper, to apply an inward pressure on the hinged sheet gripper against the elongated gripping edges to thereby tightly force the hinged sheet gripper elongated edges together to hold the sheet tightly in position around the mattress edge in proximity to the sheet gripper.

9. The improvement as defined in claim 8 wherein the sheet gripper elongated gripping edges have formed thereon a male edge on one side thereof and a female edge on the other side thereof for mating engagement to improve the holding and gripping ability of the sheet gripper on the mattress edges.

10. The improvement as defined in claim 8 wherein the hinge has a thickness ranging between 8 and 10 thousandths of an inch.

11. The improvement as defined in claim 10 wherein the sheet gripper is formed from polypropylene which permits the hinge to move back and forth many times without cracking.

12. The improvement as defined in claim 8 wherein the pressure means comprises in part a rigid outer semicircular open-ended clamp having an inside surface sliding over the hinged sheet gripper and comprises in part the sheet gripper being formed with an elongated taper on its outside surface and the semicircular clamp being formed with a similar taper on its inside surface so that the taper on the inside surface of the clamp will force the taper on the outside surface of the sheet gripper to tightly force the elongated gripping edges together whenever the clamp is tightly positioned over the sheet gripper.

13. The improvement as defined in claim 12 wherein the elongated hinge is formed with a female semicircular opening along the hinge and the clamp is formed with a mating semicircular male protuberance along the inside surface of the clamp for engagement with the female semicircular opening whenever the clamp slides over the hinged sheet gripper, thereby aligning the clamp with the sheet gripper in a predetermined position.

14. The improvement as defined in claim 12 wherein the tapers formed on the sheet gripper and the clamp range approximately from 2° to 6°.

15. The improvement as defined in claim 14 wherein the tapers formed on the sheet gripper and the clamp are approximately 4°.

16. A device for gripping a portion of a flexible surface around an elongated form of the type having an outer surface, the elongated form also being they type such as a cord, rope, protruding edge or the like, the device serving to hold the portion of a flexible surface in juxtaposition around the elongated form using only the device and not other holding means, comprising:

(a) an inner gripper having an inner surface formed in the approximate shape of the outer surface of the elongated form, the inner gripper being designed for positioning partly around the elongated form and around the flexible surface without distorting the inner surface of the gripper as the gripper is positioned partly around the elongated form;

(b) an outer pressure applying clamp for positioning partly around the inner gripper after the gripper is positioned over the elongated form with the flexible surface positioned between the gripper and the elongated form; and (c) pressure means, associated with at least the clamp, for applying an inward pressure from the clamp to the inner gripper to tightly force the gripper against the flexible surface when the pressure means is applied by the clamp which then tightly forces the portion of a flexible surface against the elongated form to hold the portion of a flexible surface tightly on the elongated form using the device only and not other holding means.

17. The device as defined in claim 16 wherein the outer pressure applying clamp has formed thereon a protuberance having an opening therein to receive a second elongated form such as a cord, rope, strap or the like.

18. The device as claimed in claim 17 wherein the outer pressure applying clamp is formed with an outer surface and the protuberance is formed on the outer surface of the clamp.

19. The device as defined in claim 16 wherein the outer pressure applying clamp is formed with an enlarged upper surface having an opening formed therein to receive a second elongated form such as a rope, cord, strap or the like.

20. The device as defined in claim 16 wherein the inner gripper is formed in a one-piece configuration having opposed sides and having an upper and lower portion with each portion having an integral configuration conforming to the shape and size of the elongated form, the upper and lower portion being attached together by a hinge section formed one side thereof, the upper and lower portions also having gripping edges formed along the other side thereof opposite to the hinge section.

21. The device as defined in claim 16 wherein the inner gripper is formed in at least a two-piece configuration with an upper portion and a lower portion, each portion having an integral configuration conforming in part to the shape and size of the elongated form, each portion also having edges formed along opposite sides thereof which are tightly held together when the outer pressure applying clamp is positioned partly around the two-piece gripper.

* * * * *